United States Patent [19]

Milligan

[11] 4,325,758

[45] Apr. 20, 1982

[54] HEAT TREATMENT FOR HIGH CHROMIUM HIGH CARBON STAINLESS STEEL

[75] Inventor: Edward J. Milligan, Marion County, Ind.

[73] Assignee: Western Electric Company, Inc., New York, N.Y.

[21] Appl. No.: 193,237

[22] Filed: Oct. 2, 1980

[51] Int. Cl.[3] ..... C21D 1/32

[52] U.S. Cl. ..... 148/135; 148/3; 148/125; 148/136; 148/144

[58] Field of Search ..... 148/12 R, 3, 135, 136, 148/144, 125, 16.7, 37, 38, 134; 75/126 A

[56] References Cited

U.S. PATENT DOCUMENTS

| | | | |
|---|---|---|---|
| 2,486,282 | 10/1949 | Hoffman et al. | 148/135 |
| 2,773,761 | 12/1956 | Fuqua et al. | 75/126 A |
| 3,732,127 | 5/1973 | Furgason | 148/144 |
| 3,859,147 | 1/1975 | Philip | 148/135 |

FOREIGN PATENT DOCUMENTS

| | | | |
|---|---|---|---|
| 52-12612 | 1/1977 | Japan | 75/126 A |

*Primary Examiner*—Peter K. Skiff
*Attorney, Agent, or Firm*—J. F. Spivak

[57] ABSTRACT

A process for softening high carbon, high chromium steel to render it machinable includes pre-heating, homogenizing, isothermally annealing and slow cooling the steel.

13 Claims, No Drawings

HEAT TREATMENT FOR HIGH CHROMIUM HIGH CARBON STAINLESS STEEL

TECHNICAL FIELD

This invention relates to the annealing of hard, high chromium, high carbon, cast stainless steels to make them more readily machinable and to the rehardening of the machined pieces.

BACKGROUND OF THE INVENTION

As can be seen from U.S. Pat. Nos. 2,486,282, 3,082,132, 3,846,189, 3,401,035, 2,395,608 and 3,598,660, heat treating processes for various steels to alter their physical properties such as hardness, machinability and brittleness, are generally known in the art. However, there is still a need for a process to alter the hardness of very hard, as cast, high chromium, high carbon stainless steels to make them more readily machinable. Heretofore, the difficulty of machining steels such as those containing from 1 to 2% carbon, 12 to 18% chromium, 1 to 2% molybdenum and normal amounts of other elements such as silicon, boron and the like, the balance being substantially iron, has restricted their use to the as cast form. An example of such a steel which typically has a Rockwell hardness of C60–C62 is Zevescal W, manufactured by Columet Steel Casting Corporation. This steel has the following composition: C—2.0%, Cr—16.0%, Mo—1.75%, Si—1.0%, B—trace, the balance being iron.

By treating such steel in accordance with this invention, I have surprisingly discovered that the hardness can be reduced to as low as C20–C30 making it possible to readily machine any cast parts, thereby expanding the potential uses of the steel. By further thermal treatment, as disclosed herein, the steel can be rehardened after machining to a hardness of about C60 where it exhibits excellent wear characteristics.

SUMMARY OF THE INVENTION

A method for improving machinability of very hard, cast, high chromium, high carbon stainless steels comprises:

(a) pre-heating the steel to a temperature somewhat below the critical point; then (b) homogenizing the steel at a temperature in excess of that necessary to dissolve the chromium carbide into the grain matrix without substantially increasing grain size; and then (c) isothermally annealing the homogenized steel to form a spheroidized structure; and then (d) cooling the annealed steel.

Subsequent to annealing, the steel may be machined and then rehardened, if desired, after machining.

The method of rehardening the previously softened high carbon, high chromium content steel workpiece comprises the steps of:

(a) pre-heating the steel to a temperature below its critical point;

(b) austentizing the steel;

(c) quenching;

(d) tempering to form tempered martensite;

(e) freezing the workpiece at a temperature of from −120° F. to −150° F. for at least 16 hours; and (f) retempering the workpiece.

DETAILED DESCRIPTION

Previously, high carbon, high chromium, hard, as cast, steel such as Zevescal W which has a Rockwell hardness of about C60–62 could not be readily machined due to this hardness. I have discovered a heat treatment process which can reduce the hardness to a level as low as C20–C25 making it possible to readily machine cast parts made of such steels and also to then reharden the machined part. While the examples which appear herein deal with processing Zevescal W steel, it should be recognized that the process should be suitable for softening other similar high carbon, high chromium, hard, cast steel parts. The terms hard, high carbon and high chromium steels refer to stainless steels having a hardness which inhibits ready machining of the workpiece, e.g., Rockwell hardnesses of greater than C50, a carbon content in excess of about 1% and a chromium content in excess of about 12%.

Preferably the novel process is performed in a vacuum furnace so as to facilitate the temperature cycling required by the process in a continuous manner.

Generally, the process comprises pre-heating the workpiece in a vacuum, e.g., 10 microns, at a temperature just below the critical point of the steel. The critical point is that temperature at which a phase transformation from body-centered cubic to face-centered cubic starts to occur. While the critical point depends upon the particular composition of the steel, typically critical points range from about 1540° F. to about 1600° F., and suitable pre-heat temperatures are from 1400° F. to 1500° F., respectively, or from about 100° F.–150° F. below the critical point. The step of pre-heating facilitates the later dissolution of carbide and since as cast, high carbon, high chromium steels have relatively poor thermal conductivity, this step also minimizes thermal shock which can crack the castings if rapidly heated to the homogenization temperature. Subsequent to preheating, the furnace temperature is raised for homogenizing the steel workpiece in order to dissolve the carbides, e.g., chromium carbide, into the grain matrix of the steel. This step serves to break up the coarse carbide networks associated with the casting process and diffuses the alloys to form a more evenly distributed structure. Homogenization must be carried out at a temperature in excess of that necessary to dissolve the carbides. The selected temperature should cause dissolution of the carbides at a reasonable rate but preferably should not be so high as to substantially increase grain size of the matrix. I have found that a temperature of about 150° F. above the temperature required for dissolution of the carbide is preferred. While this temperature depends somewhat on the specific composition of the steel, generally, homogenization at about 1950° F., or somewhat higher, for times of from 3–5 hours, depending upon the mass and composition, in a vacuum of from about 500–1,000 microns is preferred. Following homogenization, the workpiece is isothermally annealed. During this step, whereby the furnace temperature is reduced, the structure of the steel is transformed from a face-centered cubic structure of carbide plus austenite, to a spheroidized structure of excess carbide plus ferrite where the carbide in solution in the austenite phase is caused to precipitate out as a finely and uniformly dispersed spheroidized carbide which is excellent for machinability of the steel workpiece. The Rockwell hardness of this steel is reduced to C20 to C30. Typical annealing temperatures are from 1200° F. to 1400° F.

while temperatures of from 1250° F. to 1350° F. are preferred. Typical annealing times at the preferred temperatures are from 6 to 8 hours. Subsequent to annealing, the steel workpiece is cooled by backfilling the vacuum furnace with nitrogen. Cooling rates are preferably ≦515° F./minute. Once cool enough to handle, the workpiece can be machined as desired.

It should be noted that the reduction in hardness of the as cast steel from about C60–C65 to as low as C20–C30 was unexpected and surprising.

After the steel has been machined, it can then be rehardened. The rehardening process includes a preheat as described before, i.e., in a vacuum of about 10 microns at a temperature of between 1400° F. and 1500° F. (preferably about 1475° F.) for at least 20 minutes. The steel workpiece is then austenitized in a vacuum of 500 to 1000 microns by heating to a temperature of from 1925° F. to 1975° F. (preferably 1950° F.) for a period equivalent to at least 20 minutes plus 15 minutes for each inch of section thickness. The austenitized steel is then gas guenched by backfilling the vacuum furnace with nitrogen gas. Subsequent to quenching, the workpiece is tempered to form the tempered martensite structure by heating it at a temperature of from 900° F. to 955° F., about 920° F. to 930° F. being preferred, for a period of typically about 2 hours. The tempering time, while being adequate for substantial conversion to the tempered martensitic structure, is not otherwise critical. In fact, some face-centered cubic austenite will generally remain.

In order to achieve superior wear quality of the rehardened, machined workpiece, it has unexpectedly been found that a freezing step subsequent to the first tempering step is critical in that the workpiece must be cooled to a temperature of from −120° F. to −150° F. and should preferably be held at this temperature for a minimum time of about 16 hours, independent of its mass. While times somewhat less than 16 hours may be adequate, freezing times of less than 8 hours have resulted in finished rehardened steel workpieces that do not appear to have the superior wear resistance desired. For example, under certain circumstances, minor cracks develop upon use and upon the application of stress during use of the workpiece not subjected to the longer freezing time.

The final step in the rehardening process is a second tempering step wherein the steel is tempered at a temperature of from 400° F. to 500° F., typically for at least about 2 hours, and then cooled to room temperature.

By this process, the original as cast Rockwell hardness of the steel can be substantially regained. Typically, final hardness of from C60–C62 starting with as cast steel pieces with about the same hardness can be achieved. One difference noted in the rehardened steel as compared with the as cast material prior to softening is that the grain size of the rehardened material is finer than the original, as cast, material.

EXAMPLE I

Here, softening of an as cast Zevescal W 3-½" diameter disc having a hardness of Rockwell C55 was attempted by a standard pack annealing process wherein the steel piece was packed in a sealed container along with iron chips and heated slowly to 1650° F., held at that temperature for 4 hours and slow cooled to room temperature at a rate of ≦50° F./hr. The steel still had a hardness of C54 after this process.

EXAMPLE II

The same type of as cast steel as used in Example I was isothermally annealed in a vacuum furnace as follows:

(a) pre-heated at 1450° F. for ½ hour at 10μ vacuum;
(b) heated to 1650° F. for 1 hour in a vacuum of 500μ;
(c) heated at 1450° F. for 6 hours in vacuo; and
(d) slow cooled.

This steel still had a hardness of C52 after processing.

EXAMPLE III

A small lot of Zevescal W castings, each weighing about 5 pounds, was treated in an Ipsen vacuum furnace as follows:

(a) pre-heat at 1450° F. for 1 hour, vacuum 10 microns;
(b) homogenize at 1950° F. for 3 hours, vacuum 500 microns;
(c) cool with a $N_2$ backfill overnight;
(d) pre-heat again to 1450° F. for 1 hour;
(e) austenitize at 1650° F. for 1-½ hours at 500 microns;
(f) isothermal anneal at 1435° F. for 6 hours; and
(g) $N_2$ backfill and cool overnight.

After processing the hardness was reduced to Rockwell C44–C45.

EXAMPLE IV

Zevescal castings weighing 30 pounds each and having a hardness of Rockwell C61 were treated as in Example III except that isothermal annealing was extended to 8 hours. Here, the hardness was C50. However, when the castings were re-isothermally annealed at 1320° F. for 4 hours, the hardness was unexpectedly reduced to Rockwell C17–22.

EXAMPLE V

Two 30 pound cylindrical Zevescal W castings were treated as follows in a cold wall vacuum furnace:

(a) pre-heat at 1450° F. for 1 hour, at 10 microns;
(b) homogenize at 1950° F. for 4-½ hours, at 500 microns;
(c) isothermal anneal at 1320° F. for 6 hours, shut off furnace; and
(d) backfill with $N_2$ and cool at about 15° F./min. to room temperature.

The final hardness was 32–34.

EXAMPLE VI

Thirty pound Zevescal W castings were treated as follows in a vacuum furnace:

(a) pre-heat at 1450° F.–1500° F. for 1 hour, 10 micron vaccum;
(b) homogenize at 1950° F. for 4 hours, 500 micron vacuum;
(c) isothermal anneal at 1350° F. for 6 hours, 500 micron vacuum;
(d) backfill with $N_2$, shut off furnace and allow to cool; and
(e) re-isothermal anneal at 1300° F. for 4 hours and again cool.

This sample attained a hardness of Rockwell C28–C30.

EXAMPLE VII

Thirty pound Zevescal W castings were treated in a vacuum furnace as follows:

(a) pre-heat at 1450° F.–1475° F. for from 1–2 hours at 10 microns;

(b) homogenize at 1950°±10° F. for 3–6 hours at 500 microns;

(c) isothermal anneal at 1300° F.–1325° F. for 8–12 hours;

(d) $N_2$ backfill and cool at ≦15° F./min. to room temperature.

These samples had Rockwell C hardnesses of from 20–32.

EXAMPLE VIII

The softened castings (C20–C34) were machined as desired with high-speed steel tools and then rehardened to Rockwell C60–C62 as follows:

(a) pre-heat to 1475° F. for ≦20 minutes;

(b) austenitize at 1950° F. for 30 minutes at 500 microns;

(c) gas quench with $N_2$ backfill;

(d) temper at 925° F. for 2 hours;

(e) freeze at −120° F. for 16 hours;

(f) re-temper at 450° F. for 2 hours; and (g) cool.

The rehardened samples were tested for errosion and corrosion resistance in molten zinc and were found to be equivalent to the as cast material.

What is claimed is:

1. A process for softening hard, as cast, high chromium, (>12% Cr), high carbon (>1% C) steel, which comprises:

(a) pre-heating the steel to a temperature somewhat below its critical point for a suitable period of time;

(b) raising the temperature of the steel for a given period of time to a temperature in excess of that necessary to dissolve chromium carbide into the steel grain matrix without substantially increasing grain size of the matrix, thereby homogenizing the steel;

(c) isothermally annealing the homogenized steel at a temperature and for a time so as to form a substantially spheroidized structure; and (d) cooling the annealed steel.

2. The process described in claim 1 wherein the as cast steel has a Rockwell hardness of at least C50 and wherein the steel contains from 1 to 2% carbon and 12 to 18% chromium.

3. The process described in claim 1 wherein the steel has a Rockwell hardness of C60 or greater and contains approximately 2% carbon, 16% chromium, 1.75% molybdenum, 1% silicon, the balance essentially being iron.

4. The process recited in claim 1 wherein the heating cycle is performed in a partial vacuum.

5. The process described in claim 4 wherein pre-heating is done in a vacuum of about 10 microns while the steps of homogenizing and annealing are done in vacuums of from 500 to 1000 microns.

6. The process recited in claim 5 wherein the step of cooling is performed by backfilling the vacuum with nitrogen and at a rate of ≦15° F./min.

7. The process recited in claim 1 wherein the preheating temperature is between 1400° F. to 1500° F., homogenization is carried out at about 1950° F. or greater for times of at least 3 hours in a vacuum of about 500 to 1000 microns, and isothermal annealing is carried out at temperatures in the ranges of 1200° F. to 1400° F. for a time of at least 6 hours in a vacuum of from 500 to 1000 microns and where the final softened steel has a Rockwell hardness of from C20 to C30.

8. The process recited in claim 1 performed in a vacuum furnace wherein a vacuum of about 10 microns is utilized for pre-heating and from 500 to 1000 microns is used in the steps of homogenizing and annealing, and further the pre-heating is done between 100° F. to 150° F. below the critical point of the steel, homogenization is carried out at a temperature of about 150° F. or more above the temperature required for dissolution of the carbide and wherein annealing is carried out from temperatures from 1250° F. to 1350° F.

9. A process for softening as cast steel having a Rockwell hardness of C60 to C65 and a composition of 2% carbon, 16% chromium, 1.75% molybdenum, 1% silicon and the balance being substantially iron, comprising the steps of:

(a) pre-heating the steel at a temperature of from 1450° F. to 1500° F. for a least 1 hour in a partial vacuum;

(b) homogenizing the steel at a temperature of about 1950° F. for a least 3 hours in a vacuum of from about 500 to 1000 microns;

(c) isothermally annealing the homogenized steel at a temperature of from 1300° F. to 1350° F. for a time of at least 4 hours in a vacuum of from 500 to 1000 microns; and (d) cooling the annealed steel by means of a gas quench.

10. A process for machining hard, as cast, high chromium, high carbon steel comprising the steps of:

softening the steel in accordance with the process recited in claim 1; and machining the softened steel.

11. The process recited in claim 10 including the step of rehardening the machined steel.

12. The process recited in claim 11 wherein rehardening includes the steps of:

(a) pre-heating;

(b) austenitizing;

(c) quenching;

(d) tempering;

(e) freezing at a temperature of from −120° F. to −150° F. for at least 16 hours; and (f) re-tempering the steel.

13. The process recited in claim 11 including the steps of:

(a) pre-heating the steel for at least 20 minutes between 1400° F. to 1500° F.;

(b) austenitizing the steel at a temperature of from 1925° F. to 1975° F.;

(c) gas quenching the austenitized steel;

(d) tempering as follows:

(1) heating at between about 900° F. to 950° F.;

(2) freezing at from −120° F. to −150° F. for at least 16 hours; and (3) heating at from 400° F. to 550° F.

* * * * *

UNITED STATES PATENT AND TRADEMARK OFFICE

CERTIFICATE OF CORRECTION

PATENT NO. : 4,325,758
DATED : April 20, 1982
INVENTOR(S) : E. J. Milligan

It is certified that error appears in the above—identified patent and that said Letters Patent is hereby corrected as shown below:

On the title page, under the section entitled "References Cited," the following references should be listed:

| | | | |
|---|---|---|---|
| 2,395,608 | 2/1946 | Aborn | 148/21.55 |
| 3,082,132 | 3/1963 | Mclill et al. | 148/136 |
| 3,401,035 | 9/1968 | Moskowitz et al. | 75/126 |
| 3,598,660 | 8/1971 | Ferree, Jr. | 148/12 |
| 3,846,189 | 11/1974 | Tipnis | 148/135 |

A-L Blue Sheet-Allegheny Ludlum Ontario and Ontario-EZ Air Hardening Die Steels AISI Type D2, Printed by Allegheny Ludlum Steel Corporation, Pittsburgh, Pa.

In the specification, Column 3, line 6, "≤515°F." should read --≤15°F.-- Column 5, line 16, "≤20" should read --≥20--.

In the claims, Column 6, claim 8, line 7, "claim 1" should read --claim 2--.

Signed and Sealed this

*Twenty-seventh* Day of *July 1982*

[SEAL]

*Attest:*

GERALD J. MOSSINGHOFF

*Attesting Officer* *Commissioner of Patents and Trademarks*